US010293600B2

(12) United States Patent
Kanke

(10) Patent No.: US 10,293,600 B2
(45) Date of Patent: May 21, 2019

(54) INK JET RECORDING DEVICE

(71) Applicant: CANON KABUSHIKI KAISHA, Tokyo (JP)

(72) Inventor: Tsuyoshi Kanke, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 72 days.

(21) Appl. No.: 15/205,941

(22) Filed: Jul. 8, 2016

(65) Prior Publication Data

US 2017/0008312 A1 Jan. 12, 2017

(30) Foreign Application Priority Data

Jul. 10, 2015 (JP) ..... 2015-138671

(51) Int. Cl.
*B41J 2/165* (2006.01)
*B41J 2/01* (2006.01)

(52) U.S. Cl.
CPC ..... *B41J 2/01* (2013.01); *B41J 2/165* (2013.01); *B41J 2/1652* (2013.01); *B41J 2/16535* (2013.01); *B41J 2/16552* (2013.01)

(58) Field of Classification Search
CPC ..... B41J 2/01; B41J 2/11; B41J 2/1433; B41J 2/17; B41J 2/17593; B41J 2/2107; B41J 2/1755; B41J 2/2114; B41J 2/2117; B41J 2/2056; B41J 2/21; B41J 2/0057; B41J 3/60; B41J 2002/012; B41J 2/04598; B41J 2/04588; B41J 2/04595; B41J 2/04586; B41J 2/14274; B41J 11/0015; B41J 11/002; C09D 11/36; C09D 11/40; C09D 11/30; C09D 11/38; C09D 11/32; C09D 11/322; C09D 11/324; C09D 11/328; C09D 11/101; C09D 11/102; C09D 11/005; C09D 11/54; C09D 11/52; B41M 5/0011; B41M 5/0017; B41M 5/0047; B41M 7/00; B41M 7/0072; B41M 5/52; B41M 5/5218
See application file for complete search history.

(56) References Cited

U.S. PATENT DOCUMENTS

2002/0062762 A1* 5/2002 Tomioka ..... C09D 11/40 347/56
2007/0137519 A1* 6/2007 Sugimoto ..... B41J 2/16552 106/31.13
2011/0012956 A1* 1/2011 Kagata ..... B41J 2/16532 347/29
2012/0306966 A1* 12/2012 Tanaka ..... B41J 2/16523 347/36

(Continued)

FOREIGN PATENT DOCUMENTS

JP 2004-167772 A 6/2004

*Primary Examiner* — Manish S Shah
(74) *Attorney, Agent, or Firm* — Canon U.S.A. Inc., IP Division

(57) ABSTRACT

An ink jet recording device capable of maintaining an ejection stability for a long period of time. The ink jet recording device includes a recording head having an ejection port configured to eject an aqueous ink and an ejection-port surface in which the ejection port is opened and a liquid supply mechanism configured to supply an ejection-port clogging prevention liquid into the ejection port, the aqueous ink contains at least one component selected from the group consisting of pigment particles and resin particles, and the clogging prevention liquid has a dielectric constant of 20 to 40 at 25° C.

17 Claims, 6 Drawing Sheets

(56) References Cited

U.S. PATENT DOCUMENTS

2013/0300799 A1* 11/2013 Mizutani ..... B41J 2/16505
347/30
2014/0292912 A1* 10/2014 Satoh ..... B41J 2/1721
347/31

* cited by examiner

INK JET RECORDING DEVICE

BACKGROUND OF THE INVENTION

Field of the Invention

The present invention relates to an ink jet recording device having the structure in which a liquid is supplied into an ejection port of a recording head.

Description of the Related Art

As one technical problem of an ink jet recording device, for example, clogging at an ejection port from which ink is ejected may be mentioned. This clogging is caused by components, such as pigment and/or resin particles, contained in the ink. As the condition in which the clogging occurs, for example, there may be mentioned the case in which an ink jet recording device is left for a long period of time without being used or the case in which a recording head is left after disassembled from an ink jet recording device.

When this clogging occurs, the ink may not be stably ejected, and hence, in general, cleaning is performed to remove clogged components. As this cleaning, for example, although a method in which a suction treatment is performed to get rid of a liquid out of the election port may be mentioned, depending on the type and the content of the clogged component, the component may not be sufficiently removed in some cases.

Japanese Patent Laid-Open No. 2004-167772 has disclosed as a method to prevent clogging at an ejection port, a clogging suppression method in which when an ink jet recording device is in a standby state, an absorber absorbing a humectant is brought into contact with an ejection-port surface of a recording head to prevent the evaporation of moisture of ink.

SUMMARY OF THE INVENTION

According to one aspect of the present invention, there is provided an ink jet recording device comprising:

a recording head having an ejection port configured to eject an aqueous ink and an ejection-port surface in which the ejection port is opened; and a liquid supply mechanism configured to supply an ejection-port clogging prevention liquid into the ejection port, the aqueous ink contains at least one component selected from the group consisting of pigment particles and resin particles, and the dielectric constant of the clogging prevention liquid is 20 to 40 at 25° C.

The present invention provides an ink jet recording device which can prevent clogging at an ejection port of a recording head caused by aggregation of dispersion particles in ink and which can maintain an ink ejection stability for a long period of time.

Further features of the present invention will become apparent from the following description of exemplary embodiments with reference to the attached drawings.

DESCRIPTION OF THE EMBODIMENTS

Figure 1A:
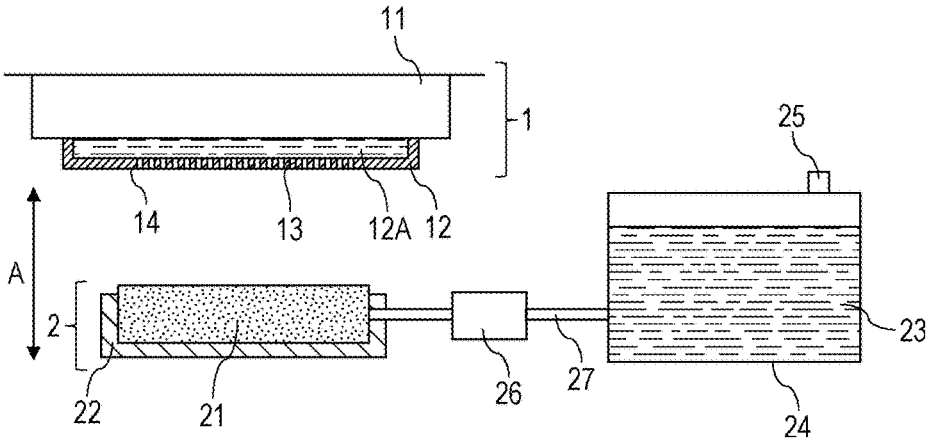
FIGS. 1A and 1B are each a schematic cross-sectional view showing a first embodiment of a recording head and a supply mechanism of a clogging prevention liquid according to the present invention.

When the clogging prevention method disclosed in Japanese Patent Laid-Open No. 2004-167772 was applied to clogging prevention of an ink containing dispersion particles, it was difficult in some cases to sufficiently prevent the clogging. In particular, when the concentration of pigment and/or resin particles in the ink was 10 percent by mass or more, it was more difficult to prevent the clogging. In particular, depending on the type of humectant to be absorbed in the absorber, the aggregation is promoted in some cases by contact with pigment and/or resin particles in the ink, and conversely, the clogging is liable to occur in some cases.

The present invention was made based on the understanding of the problems described above. That is, the present invention provides an ink jet recording device which can prevent clogging at an ejection port of a recording head caused by aggregation of dispersion particles in ink and which can also maintain an ink ejection stability for a long period of time.

An ink jet recording device according to the present invention comprises: a recording head having an ejection port ejecting an aqueous ink (hereinafter, referred to as "ink") and an ejection-port surface in which the ejection port is opened; and a liquid supply mechanism supplying a clogging prevention liquid into the ejection port. The ink to be supplied to the recording head of the ink jet recording device according to the present invention contains dispersion particles. As the dispersion particles described above, at least one type of pigment and resin particles may be mentioned. That is, particles in a dispersed state are contained in the ink. Dependent on the degree of moisture evaporation from the ink, the clogging may occur in some cases by aggregation or film formation of the dispersion particles at the ejection port of the recording head or in the vicinity thereof. The ink jet recording device of the present invention can prevent the clogging described above since having the liquid supply mechanism supplying the clogging prevention liquid into the ejection port.

As the clogging prevention liquid, a liquid having a dielectric constant of 20 to 40 at 25° C. is used. When this clogging prevention liquid is supplied into the ejection port of the recording head, the ink ejection stability can be maintained for a long period of time.

When the moisture in the ink containing the dispersion particles, such as pigment and/or resin particles, is evaporated, the dispersion particles are liable to be associated with each other since the concentration thereof is relatively increased, and as a result, aggregates are generated. In particular, in the vicinity of the ejection port at which the moisture evaporation is liable to occur, the probability of occurrence of the clogging caused by aggregation of the dispersion particles is increased.

The present inventor considered that when the dispersion particles are moved from the vicinity of the ejection port at which moisture in a nozzle of the recording head is liable to evaporate to a rear side direction of the ejection port, that is, for example, to a liquid chamber side, which is not likely to be influenced by the moisture evaporation, the clogging caused by aggregation of the dispersion particles can be suppressed. Accordingly, in order to move the dispersion particles to the rear side direction of the ejection port, the present inventor investigated a method to forcedly move the dispersion particles to the rear side direction of the ejection port by intruding a clogging prevention liquid into the ejection port therethrough. As a result, it was found that when the clogging prevention liquid having a dielectric constant of 20 to 40 at 25° C. is supplied from the ejection port, the dispersion particles can be efficiently moved to the rear side direction of the ejection port and are not likely to come close to the vicinity of the ejection port, so that the clogging in the vicinity of the ejection port can be suppressed.

In the present invention, since the liquid supply mechanism which supplies the clogging prevention liquid is provided, the clogging prevention liquid having a dielectric constant of 20 to 40 can be intruded into the ejection port therethrough, so that an ink present in the vicinity of the ejection port is moved to the rear side direction of the ejection port. As described above, since the clogging prevention liquid is intruded from the outside of the recording head into the ejection port located at a nozzle end of the recording head by using the liquid supply mechanism, the vicinity of the ejection port of the nozzle is filled with the clogging prevention liquid having a dielectric constant of 20 to 40. Accordingly, the rear side of the ejection port is filled with an ink having a dielectric constant higher than that of the clogging prevention liquid. When the liquids having different physical properties are sequentially filled in the nozzle having a minute diameter as described above, since the area of a contact portion between the two liquids is small, even if being mixed with each other to some extent at this contact portion, the liquids located apart from this contact portion are separately present from each other.

In the case described above, since the dispersion particles in the ink stay at an ink side, that is, at the rear side of the ejection port, at which the dispersion particles can be stably dispersed, the dispersion particles are not likely to be moved to the vicinity of the ejection port filled with the liquid having a lower dielectric constant, that is, to a front portion of the ejection port of the nozzle. Accordingly, since the dispersion particles are not present in the vicinity of the ejection port, or even if being present, since the dispersion particles have not a sufficient particle concentration to form an aggregate or a film causing the clogging; hence, it is believed that the clogging can be suppressed. In particular, a significant advantage of the present invention can be obtained in the case of using a high concentration ink which contains the dispersion particles at a concentration of 10 percent by mass or more and which may cause the clogging with a high probability.

<Liquid Supply Mechanism>

Hereinafter, embodiments of the liquid supply mechanism supplying the clogging prevention liquid of the ink jet recording device according to the present invention will be described with reference to the drawings. However, the constituent elements of the embodiments are merely described by way of example, and it is not intended that the scope of the present invention is limited only thereto. In addition, in this specification and the drawings, constituent elements having the same function are designated by the same reference numeral, and duplicated description may be omitted in some cases.

Embodiment 1

Figure 1B:
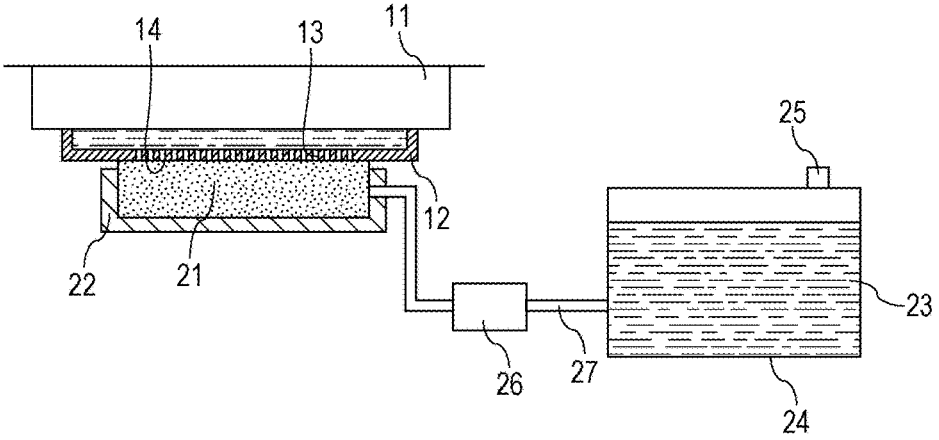

FIGS. 1A and 1B are each a schematic cross-sectional view showing a first embodiment of the recording head and the liquid supply mechanism for the clogging prevention liquid according to the present invention. In each of FIGS. 1A and 1B, a vertical cross-sectional view of the recording head and the liquid supply mechanism is schematically shown along a longitudinal arrangement direction of nozzles.

FIG. 1A shows the state in which a recording head 1 is located apart from a liquid supply mechanism 2. In a porous absorber 21 functioning as a liquid holding portion, the clogging prevention liquid is impregnated. FIG. 1B shows the state in which the porous absorber 21 holding the clogging prevention liquid is pressed to an ejection-port surface 14 of the recording head 1.

The recording head 1 has a liquid chamber 11, a nozzle chip 12, nozzles 13 each having an ejection port at a front portion, and the ejection-port surface 14 having an opening of each ejection port. The liquid chamber 11 temporarily stores an ink and then supplies the ink to the nozzle chip 12. The nozzle chip 12 is formed of a nozzle plate having the ejection-port surface 14 in which the ejection ports functioning as open ends of the nozzles 13 are formed and a member (not shown) forming a nozzle chip-inside liquid chamber 12A communicating with the liquid chamber 11 together with the nozzle plate.

The recording head according to the embodiment shown in FIGS. 1A and 1B is a long so-called line head type recording head in which the ejection ports are arranged to form a line in a direction perpendicular to the moving direction of a recording medium. In addition, the operation mode of the recording head is not limited thereto, and for example, a so-called shuttle type recording head in which recording is performed by scanning a recording head in a direction perpendicular to the moving direction of a recording medium may also be used.

The nozzles 13 are each provided with an energy generating element (not shown) used to eject an ink droplet. In this embodiment, as the energy generating element, a heat generating element is arranged. However, the energy generating element is not limited thereto, and other methods, such as a method using a piezoelectric element, a method using an electrostatic element, and a method using a micro electro mechanical systems (MEMS) element, may also be used.

The liquid supply mechanism 2 has the porous absorber 21, a support 22, a clogging prevention liquid 23, a liquid storage tank 24, a pump 26, and a tube 27. The support 22 supports the porous absorber 21. The porous absorber 21 holds the liquid 23 and functions as a holding member of the clogging prevention liquid. The liquid supply mechanism 2 has a press unit (not shown) which enables the support 22 to move in a moving direction A so as to press the porous absorber 21 to the ejection-port surface 14 of the recording head 1.

When the liquid is supplied into the ejection port, the liquid supply mechanism 2 is moved to the recording head 1 from the state shown in FIG. 1A to the state shown in FIG. 1B so that the porous absorber 21 is pressed to the ejection-port surface 14. Since the liquid 23 is impregnated in the porous absorber 21, when the porous absorber 21 is tightly brought into contact with the ejection-port surface 14 and is further pressed thereto, the liquid 23 is oozed from the porous absorber 21 and is supplied into the ejection port from the ejection-port surface 14. Subsequently, the liquid supply mechanism 2 is moved apart from the recording head 1 and is again placed in the state shown in FIG. 1A, so that the supply of the liquid 23 is completed. In addition, the liquid 23 to be held in the porous absorber 21 can be supplied to the porous absorber 21 by the pump 26 from the liquid storage tank 24 through the tube 27. In an upper surface of the liquid storage tank 24, an air communicating port 25 is provided. When the porous absorber 21 holds a predetermined amount of the liquid 23, the liquid 23 can be stably supplied.

As the porous absorber, for example, a porous absorber formed of a hydrophilic material, such as a hydrophilic polyurethane, a hydrophilic polyolefin, or a hydrophilic poly(vinyl alcohol), each having an excellent water absorbing property and a stretchable flexibility, is preferable. As the pore diameter of the porous absorber, an arbitrary diameter in a range of several nanometers to several hundreds of micrometers may be used. The pore diameter of the porous absorber is preferably in a range of 100 nm to 100 μm. The void rate of the porous absorber is preferably 60% to 90% in consideration of the mechanical strength, the liquid holding function, and the supply function of the liquid into the ejection port.

Figure 2A:
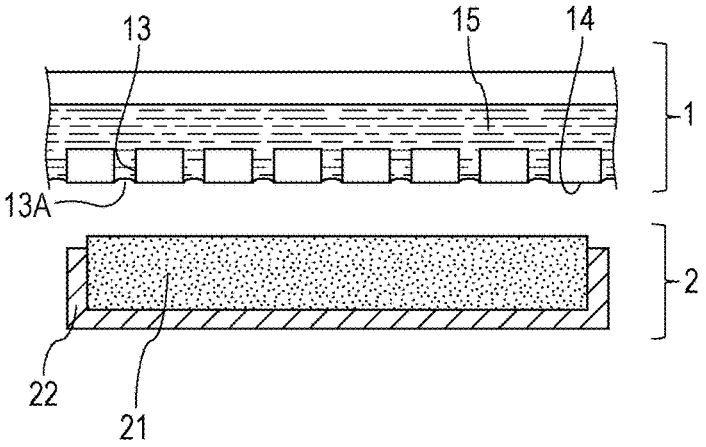
FIGS. 2A to 2C are each a schematic cross-sectional view showing the state in which the clogging prevention liquid is supplied to the recording head according to the present invention.
Figure 2B:
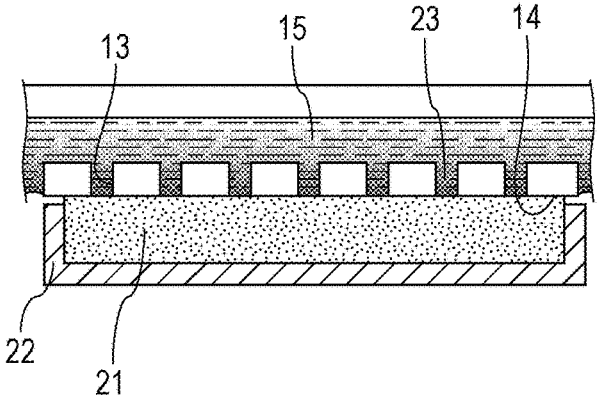
Figure 2C:
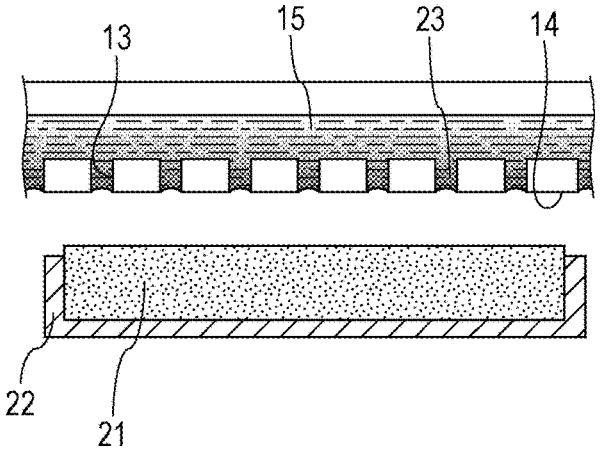

FIGS. 2A to 2C are schematic cross-sectional views particularly showing the states in which in FIGS. 1A and 1B, the liquid 23 is supplied into the ejection port of the recording head 1.

FIG. 2A shows the state in which the ejection-port surface 14 of the recording head 1 is located apart from the porous absorber 21. The porous absorber 21 is impregnated with the liquid 23. The nozzles 13 of the recording head 1 are filled with an ink 15 and are each held under a predetermined negative pressure condition, and hence, the meniscus is formed at the ejection-port surface 14. FIG. 2B shows the state in which the porous absorber 21 absorbing the liquid 23 is pressed to the ejection-port surface 14. Since the porous absorber 21 impregnated with the liquid 23 is tightly brought into contact with the ejection-port surface 14 and is pressed thereto, the liquid 23 is oozed from the porous absorber 21 and is then imparted to the ejection-port surface 14.

FIG. 2C shows the state in which the porous absorber 21 which supplies the liquid 23 into the ejection port of the recording head 1 is located apart therefrom. By the function of a force pulling the liquid 23 into the nozzle generated by the negative pressure of the nozzle, the liquid 23 in the vicinity of the ejection port which is in contact with the ink 15 is intruded into the nozzle 13 through an ejection port 13A. As a result, the inside of the front portion of the nozzle 13 including the ejection port is filled with the liquid 23 instead of the ink 15, and the ink 15 is moved to a liquid chamber side at a rear side of the nozzle. As described above, the supply amount of the liquid 23 into the ejection ports is set to correspond to the amount of the liquid 23 to be filled at least in the region in the vicinities of the ejection ports 13A of the nozzles 13, that is, in the front portions thereof at an ejection port side, and is preferably set to correspond to the amount of the liquid 23 to be filled in all the nozzles including the front portions at the ejection port side.

In order to reliably fill the liquid 23 in all the nozzles, under the state shown in FIG. 2B, the porous absorber 21 is preferably pressed to the entire ejection-port surface with a uniform pressure so as to forcibly intrude the liquid 23 into the nozzles 13.

Since the liquid 23 supplied into the nozzle 13 has a dielectric constant controlled in a range of 20 to 40, the ink 15 moved to the rear side opposite to the ejection port 13A of the nozzle 13 is not again moved to the vicinity of the ejection port. Furthermore, even if the ink 15 and the liquid 23 are brought into contact with each other, the dispersion particles in the ink 15 are not aggregated, and hence the clogging may not occur.

Immediately before the ink jet recording device of the present invention starts recording, the liquid 23 supplied into the nozzle 13 is preferably discharged out of the ejection port. Since the liquid 23 in the nozzle 13 is discharged, the vicinity of the ejection port of the nozzle 13 is filled with the ink 15 instead of the liquid 23. As a result, since the influence of the liquid 23 on the ejection of the ink 15 can be avoided, the ejection stability of the ink 15 can be maintained.

As a method to discharge the liquid 23 from the nozzle 13, for example, there may be mentioned a method in which after the ejection-port surface 14 of the recording head 1 is covered with a cap made of a rubber or the like, a negative pressure is generated from the outside, and the liquid 23 is removed from the ejection port 13A by suction, or a method in which a pressure is applied from the outside to the inside of the liquid chamber of the recording head, and the liquid is pushed out from the ejection port 13A. In addition, when the liquid 23 supplied into the nozzle 13 can be ejected in a droplet form by an energy generating element of the recording head 1, for example, if a preliminary ejection mode is provided, the liquid 23 may be discharged out of the nozzle 13 by ejection. The devices using the methods described above each may be used as a discharge mechanism.

In the embodiment shown in FIGS. 1A and 1B, although one liquid supply mechanism is provided for one recording head, when a plurality of recording heads is used, the liquid supply mechanism may be provided for each recording head.

Embodiment 2

Figure 3A:
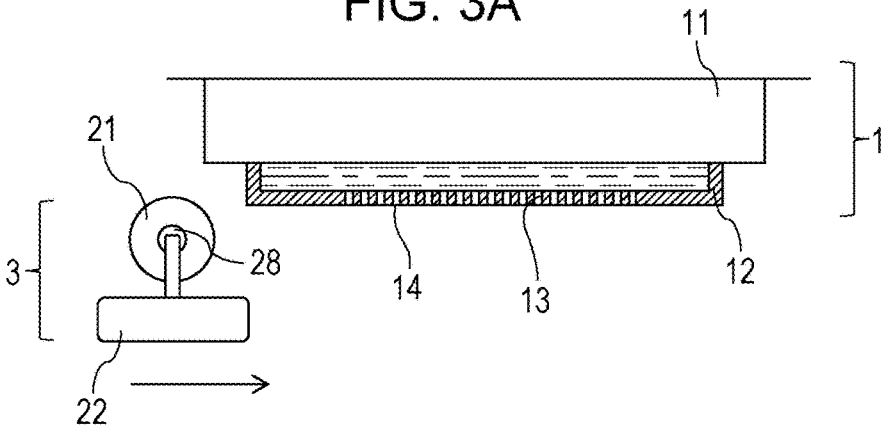
FIGS. 3A to 3C are each a schematic cross-sectional view showing a second embodiment of the recording head and the supply mechanism of the clogging prevention liquid according to the present invention.
Figure 3B:
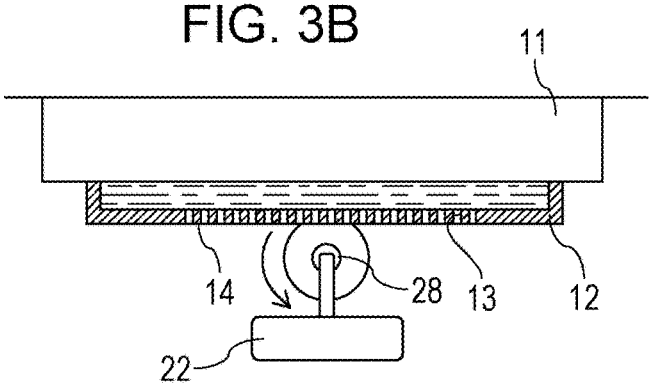
Figure 3C:
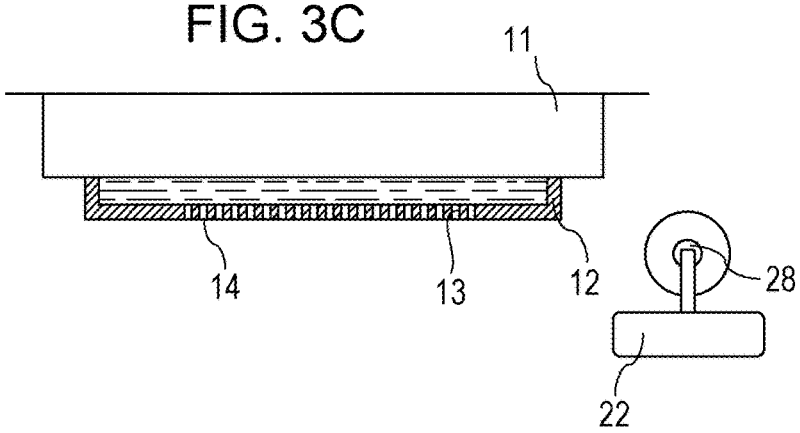

FIGS. 3A to 3C are each a schematic cross-sectional view showing a second embodiment of a recording head and a clogging prevention liquid supply mechanism. In this embodiment, a roller coating type liquid supply mechanism is used which includes a coating roller formed of a rotating shaft 28 and a roll-shaped porous absorber 21 functioning as a liquid holding portion fixed to the outer circumference surface of the rotating shaft 28. In this roller coating type, when the porous absorber 21 impregnated with a liquid 23 is pressed to an ejection-port surface 14 of a recording head 1 while being rotated, the liquid 23 is supplied to the ejection-port surface 14.

In addition, in this embodiment, the difference from the first embodiment will be primarily described, and portions which are not particularly described are substantially the same as those of the first embodiment.

A liquid supply mechanism 3 has the porous absorber 21 impregnated with the liquid 23, a support 22, and the rotating shaft 28. The roll-shaped porous absorber 21 is fixed to the outer circumference surface of the rotating shaft 28 and is rotatable around the rotating shaft 28. The support 22 rotatably supports the rotating shaft 28 and is movable along a left-to-right direction in FIG. 3.

When the liquid 23 is imparted to at least the front portion of a nozzle 13 at an ejection port side, first, from the state shown in FIG. 3A, the liquid supply mechanism 3 is moved to a recording head 1 side (direction indicated by the arrow shown in the drawing). While being rotated around the rotating shaft 28 in the direction shown by the arrow (anti-clockwise direction) as shown in FIG. 3B, the porous absorber 21 is pressed to and moved along the ejection-port surface 14, so that the liquid can be supplied into the ejection port. When the porous absorber 21 is brought into contact with the ejection-port surface 14, the surface of the porous absorber 21 is intruded thereinto to have a predetermined intrusion amount, and in the state in which a contact surface (nip portion) between the surface of the porous absorber 21 and the ejection-port surface 14 is formed, the contact movement can be precisely performed. The intrusion amount of the porous absorber 21 into the ejection-port surface 14 is selected within the range of the compressive elastic deformation of the porous absorber 21. In addition, a desired amount of the liquid 23 can be supplied into the nozzle 13 by adjusting the movement rate and the intrusion amount of the porous absorber 21. As shown in FIG. 3C, when the porous absorber 21 is moved to the position apart from the recording head 1, the supply of the liquid is completed.

A liquid supply unit of the liquid supply mechanism is not limited to that described in each of the first and the second embodiments, and various types of known liquid supply units, such as a liquid imparting unit imparting the liquid to the ejection-port surface by spraying, may be used without any particular restrictions. In addition, a liquid supply mechanism formed by combination of at least two types of liquid supply units having different supply methods may also be used.

In addition, the method of moving the liquid supply unit with respect to the recording head is not limited to that described in each of the first and the second embodiments, and a method in which at least one of the recording head and the liquid supply unit is moved may also be used.

<Ink Jet Recording Device>

Hereinafter, an embodiment of an ink jet recording device including a wiping mechanism and a capping mechanism besides the liquid supply mechanism will be described.

Figure 4:
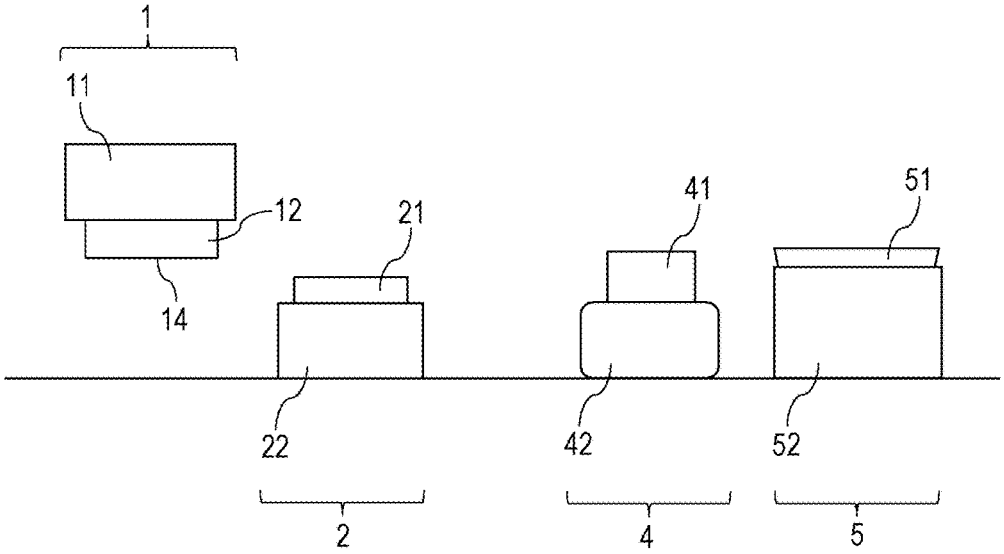
FIG. 4 is a schematic front view showing another embodiment of an ink jet recording device of the present invention.

FIG. 4 is a schematic front view showing the structure of another embodiment of the ink jet recording device according to the present invention. FIG. 4 shows the structure of the ink jet recording device according to this embodiment as a schematic cross-sectional view in a direction perpendicular to the longitudinal direction of the long recording head show in FIGS. 1A and 1B.

The ink jet recording device according to this embodiment has the recording head 1, the liquid supply mechanism 2 supplying a clogging prevention liquid, a wiping mechanism 4 wiping the ejection-port surface 14, and a capping mechanism 5 capping the ejection-port surface 14. In addition, besides the constituent elements mentioned above, the ink jet recording device described above also has a paper transport portion transporting a recording medium, a drive portion driving the recording head 1 in a left-to-right direction, a drive portion driving the liquid supply mechanism 2 in a direction along the ejection-port surface of the recording head 1, and a drive portion driving the liquid supply mechanism 2 in an up-to-down direction, each of which is not shown in the drawings. In addition, in FIG. 4, although one recording head is shown, a plurality of recording heads may also be provided. In this case, in accordance with the number of the heads, a plurality of liquid supply mechanisms, a plurality of wiping mechanisms, and a plurality of capping mechanisms are preferably provided.

<Control System>

Figure 5:
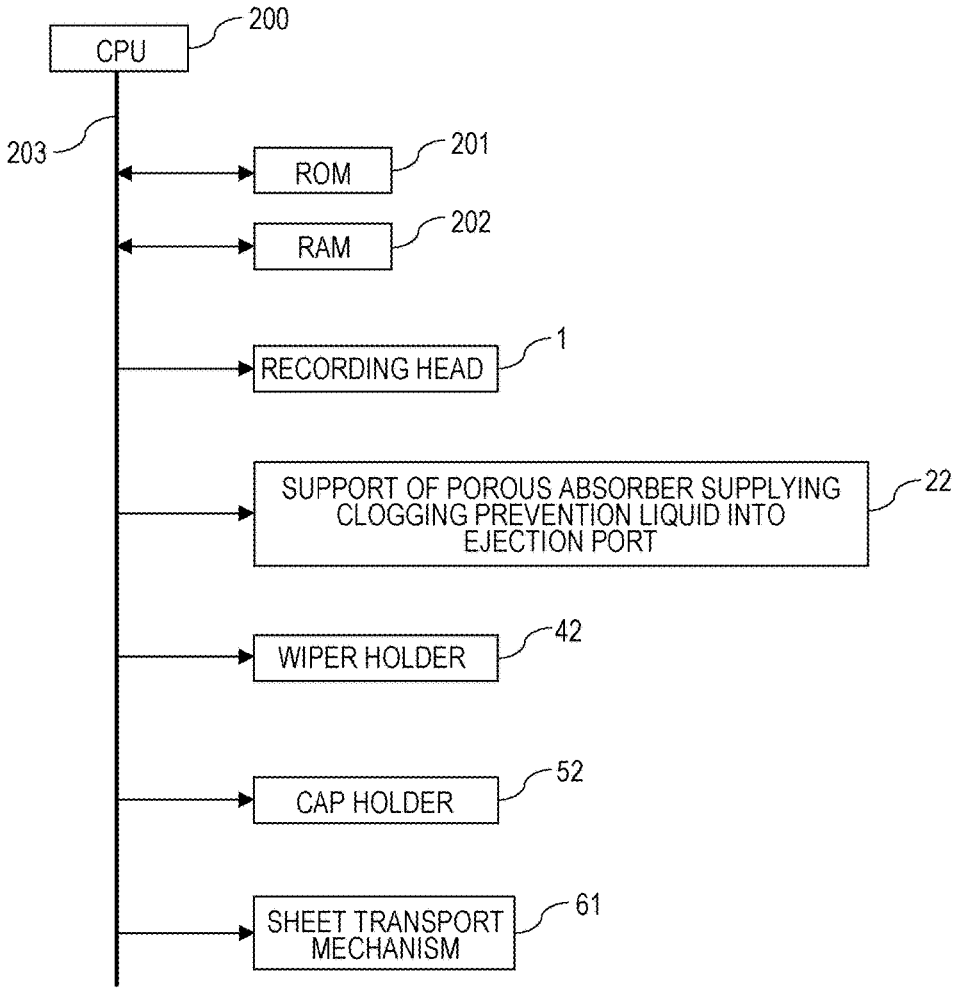
FIG. 5 is a block diagram of a control system of the ink jet recording device of the present invention.

FIG. 5 is a block diagram of a control system of the ink jet recording device according to the present invention. The ink jet recording device includes a CPU 200, a ROM 201, and a RAM 202 as components relating to the control system; the recording head 1; the support 22 of a porous absorber supplying a clogging prevention liquid into an ejection port; a wiper holder 42; a cap holder 52; and a sheet transport mechanism 61. In addition, the wiper holder 42 is provided with a wiper blade 41, and the cap holder 52 is provide with a cap 51.

The CPU 200 is a control portion responsible for various types of controls of the entire ink jet recording device, and the ROM 201 stores control programs and control data to be used by the CPU 200. The RAM 202 functions as a data storage region expanded for image processing or temporarily stores control parameters. A bus 203 transmits data and control commands. Those CPU 200, ROM 201, RAM 202, and BUS 203 play a central role in forming a controller.

Since the CPU 200 reads the control program stored in the ROM 201 and the like and implements the control program thus read, the ink jet recording device performs a printing operation, a liquid supply operation, a wiping operation, and a capping operation. The CPU 200 sends control commands of the operation in accordance with the control program to the recording head 1, the support 22 of a porous absorber supplying a clogging prevention liquid, the wiper holder 42, the cap holder 52, the sheet transport mechanism 61, and the like.

The control commands from the CPU 200 are transmitted through the BUS 203 to the recording head 1, the support 22 of a porous absorber supplying a clogging prevention liquid, the wiper holder 42, the cap holder 52, the sheet transport mechanism 61, and the like, and those constituent elements described above are operated in accordance with the commands. The sheet transport mechanism is a mechanism including, for example, a transport roller transporting a sheet at a predetermined rate on which printing is performed by the recording head 1.

The ROM 201 of the controller stores a control program for selectively implementing a printing mode, a clogging prevention liquid supply mode, a wiping mode, and a capping mode. When the printing mode is implemented, the controller controls so that while a sheet to be used as a recording medium is transported to the recording head 1 by the sheet transport mechanism, an image is formed on the sheet by ejecting an ink thereon from the recording head 1.

In the clogging prevention liquid supply mode, the CPU 200 reads a control program in which a clogging prevention liquid supply operation is described and implements the control program thus read. That is, the CPU 200 drives the support 22 of a porous absorber supplying a clogging prevention liquid and supplies the clogging prevention liquid into the ejection port. Subsequently, the CPU 200 drives the cap holder 52 to cap the ejection-port surface 14.

Figure 6:
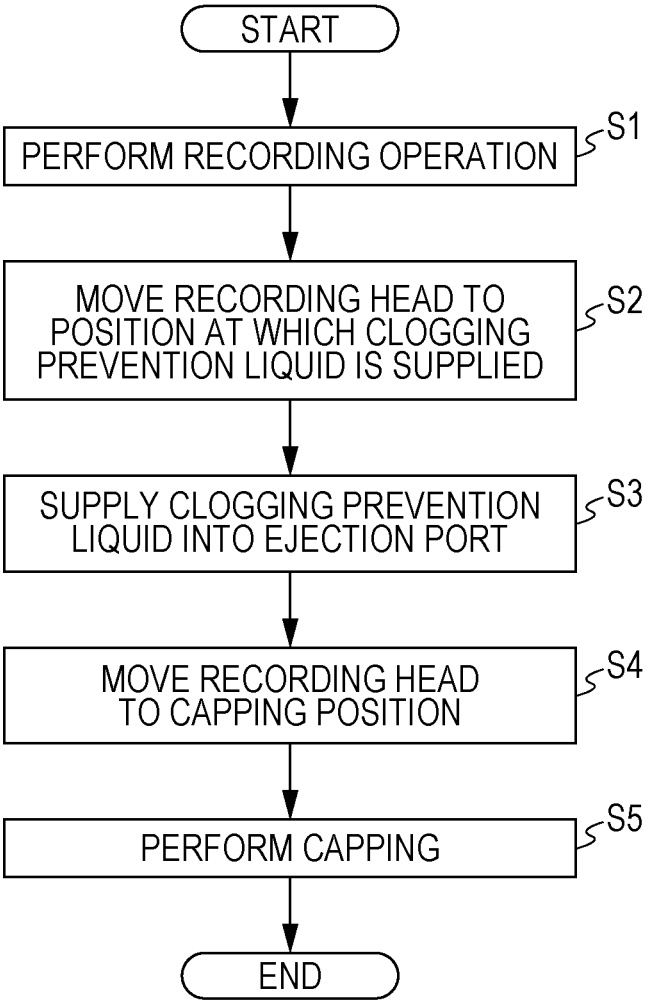
FIG. 6 is a flowchart showing a procedure to supply the clogging prevention liquid into an ejection port of the ink jet recording device of the present invention.

FIG. 6 is a flowchart showing an operation sequence of this embodiment. After recording is performed using the aqueous ink, a step of supplying the clogging prevention liquid into the ejection port is performed before the ink jet recording device is placed in a standby state. After a recording operation (S1) is performed, the recording head is moved (S2) to a position (clogging prevention liquid supply position) at which the clogging prevention liquid is to be supplied into the ejection port. Next, by the method described above, the liquid is supplied into the ejection port (S3). After the clogging prevention liquid is supplied into the ejection port, the recording head is moved to a capping position (S4) ready to be placed in a standby state. Subsequently, the ejection-port surface is capped (S5) by a capping member, so that the recording head is placed in a standby state. By the steps described above, the sequence supplying the liquid into the ejection port is completed.

In addition, when the ink is adhered to the ejection-port surface of the recording head by the recording operation S1, or the inks are mixed together in the ejection port, before the step S2 is performed, wiping may be performed, or the inks in the ejection port may be discharged. When the wiping step and/or the ink discharge step is performed before the step S2, an effect to suppress the contamination of the absorber supplying a liquid into an ejection port caused by the ink can be obtained.

<Clogging Prevention Liquid>

The dielectric constant of the clogging prevention liquid is 20 to 40 at 25° C. and is preferably 25 to 38. Furthermore, the dielectric constant at 25° C. of the clogging prevention liquid is preferably lower than the dielectric constant at 25° C. of the ink.

The dielectric constant is represented by the formula of $\varepsilon r=(Cx/C_0)$ which is the ratio of the electrostatic capacity of a measurement object to that of vacuum (Cx represents the electrostatic capacity of a sample, and $C_0$ represents the electrostatic capacity of vacuum). When the dielectric constant is high, ionic pigment and/or resin particles can be stably dispersed, and when the dielectric constant is low, ionic pigment and/or resin particles cannot be stably dispersed.

Although the dielectric constant is changed depending on the temperature, since the amount of change thereof in an estimated operation environment is small, the advantage of the present invention can be maintained when the dielectric constant is substantially set to 20 to 40 at 25° C.

According to the results of the investigation carried out by the present inventor, it was found that when the dielectric constant is set to 20 to 40 at 25° C., dispersion particles, such as pigment and/or resin particles, can be moved to a rear side direction opposite to an ejection port side of the nozzle of the recording head, and the clogging in the vicinity of the ejection port can be suppressed.

When the liquid having a dielectric constant of 20 to 40 is intruded into the nozzle through the ejection port by a clogging prevention liquid supply unit to move the ink present in the vicinity of the ejection port in the nozzle to a rear side direction opposite to the ejection port side of the nozzle, the vicinity of the ejection port in the nozzle is filled with the clogging prevention liquid having a dielectric constant of 20 to 40. In addition, the rear side in the nozzle is filled with an ink having a high dielectric constant as compared to that of the clogging prevention liquid. In this case, the dispersion particles in the ink stay in an ink located at the rear side of the ejection port at which the dispersion particles can be more stably dispersed and are not likely to be moved to the vicinity of the ejection port filled with a liquid having a lower dielectric constant. Accordingly, it is believed that since the dispersion particles are not present in the vicinity of the ejection port, or even if the dispersion particles are present, since the amount thereof is very small, the clogging can be suppressed.

The dielectric constant of a liquid in the aqueous ink is preferably 50 to 80 and more preferably 60 to 80. The dielectric constant of the liquid in the aqueous ink according to the present invention is the dielectric constant of the component obtained by removing the dispersion particles and ionic materials from the components forming the ink, that is, is the dielectric constant of the liquid formed of water, a nonionic water-soluble organic solvent, a nonionic surfactant, and the like.

When the dielectric constant of the clogging prevention liquid at 25° C. is higher than 40, the clogging prevention liquid is intruded in the vicinity of the ejection port, and the dispersion particles in the ink moved to the rear side direction of the ejection port are again moved to the vicinity of the ejection port and are aggregated, so that the clogging may occur in some cases. When the dielectric constant of the clogging prevention liquid at 25° C. is lower than 20, the dispersion particles in the ink may cause the aggregation by contact with the clogging prevention liquid, and conversely, the clogging is liable to occur in some cases.

When the clogging prevention liquid is intruded into the nozzle, in order to easily move the dispersion particles in the ink to the rear side of the ejection port, the difference in dielectric constant between the clogging prevention liquid and the liquid in the aqueous ink is preferably 25 or more.

As the clogging prevention liquid having a dielectric constant of 20 to 40 at 25° C., for example, a water-soluble organic solvent or an aqueous solution of a water-soluble organic solvent, the dielectric constant at 25° C. of which is in the range described above, may be used. As the water-soluble organic solvent, for example, a diol or a triol each having 2 to 7 carbon atoms, and pyrrolidone may be mentioned. As the diol or the triol compounds, the following may be mentioned (the number in the parentheses is a dielectric constant at 25° C.)

triethylene glycol (23)
3-methyl-1,5-pentanediol (24)
1,5-pentanediol (27)
1,2,6-hexanetriol (29)
1,2-propanediol (29)
diethylene glycol (32)

In addition, the dielectric constant of 2-pyrrolidone at 25° C. is 28.

The water-soluble organic solvents having a dielectric constant of 20 to 40 may be used alone, or at least two types thereof may be used in combination.

In addition, when the clogging prevention liquid has a dielectric constant of 20 to 40, the dielectric constant of a constituent material is not particularly limited. For example, water having a dielectric constant of 78 at 25° C. may be used as the constituent material.

Besides the components described above, if needed, the clogging prevention liquid may also contain various types of additives, such as a surfactant, a pH adjuster, a corrosion inhibitor, an antiseptic, a fungicide, an antioxidant, and a reduction inhibitor. In addition, the viscosity and the surface tension of the clogging prevention liquid are preferably adjusted so as to satisfy the supply characteristics thereof into the ejection port of the recording head. The viscosity of the clogging prevention liquid at 25° C. is preferably set to 5 to 300 mPa·s and more preferably set to 5 to 200 mPa·s. The surface tension of the clogging prevention liquid at 25° C. is preferably set to 15 to 60 mN/m and more preferably set to 20 to 50 mN/m. In addition, the clogging prevention liquid may also contain particles as long as the advantage of the present invention is not degraded. The content of the particles contained in the clogging prevention liquid is with respect to the total amount of the clogging prevention liquid, preferably less than 10 percent by mass and more preferably contains no particles.

<Ink>

The ink used for the ink jet recording device of the present invention will be described.

As the ink, an aqueous ink containing an aqueous medium and a color material is used. As the color material, at least one type of dyes and pigments may be used and may be selected from dyes and pigments which have been used as color material components for ink-jet inks.

The content of the color material of the ink may be selected in accordance with the purpose of image recording and may be selected for example, from a range of 0.1 to 15.0 percent by mass.

The ink contains dispersion particles in order to improve the fixability, the water resistance, and the weather resistance of a recorded material. As the dispersion particles described above, at least one type of pigment particles to be used as the color material and resin particles is added to the ink. In order to improve the fixability, the water resistance, and the weather resistance of a recorded material, even when the content of at least one type of pigment particles to be used as the color material and resin particles in the ink is set to 10 percent by mass or more, by the use of the clogging prevention liquid according to the present invention, the clogging at the ejection port of the recording head can be effectively prevented.

(Pigment)

As the pigment, for example, there may be used a pigment (dispersant dispersible pigment) dispersed by a dispersant and a self-dispersible pigment (self-dispersible pigment) having hydrophilic groups on the surfaces of pigment particles. In addition, for example, there may also be used a pigment (dispersant-bonded self-dispersible pigment) in which organic groups including high molecular weight materials and each functioning as a dispersant are chemically bonded to the surfaces of pigment particles, and a microcapsule pigment which is dispersible by enhancing the dispersibility of the pigment without using a dispersant. Of course, a plurality of pigments which are dispersed by different dispersion methods may also be used in combination.

When the pigment is the dispersant dispersible pigment, the acid value of the resin as the dispersant is preferably 60 to 300 mgKOH/g. Since the acid value of the resin as the dispersant is set in the range described above, when the clogging prevention liquid is supplied from the ejection port, the pigment is likely to be present at the side of an ink having a high dielectric constant. When the pigment is the self-dispersible pigment, a surface charge amount of the pigment is preferably 0.10 mmol/g or more and 2.00 mmol/g or less. Since the surface charge amount of the self-dispersible pigment is set in the range described above, when the clogging prevention liquid is supplied from the ejection port, the pigment is likely to be present at the side of an ink having a high dielectric constant. In addition, the self-dispersible pigment preferably has at least one of a carboxylic acid group, a phosphonic acid group, and a sulfonic acid group on the surface thereof. Since the pigment has at least one of a carboxylic acid group, phosphonic acid group, and a sulfonic acid group on the surface thereof, when the clogging prevention liquid is supplied from the ejection port, the pigment is likely to be present at the side of an ink having a high dielectric constant.

As the pigment, carbon black and an organic pigment are preferably used. The content (percent by mass) of the pigment in the ink is preferably set to 0.1 to 15.0 percent by mass with respect to the total mass of the ink and is more preferably set to 1.0 to 10.0 percent by mass.

As the carbon black, for example, furnace black, lamp black, acetylene black, or channel black may be used. In particular, for example, the following commercially available products may be used.

There may be used, for example, Raven: 7000, 5750, 5250, 5000 ULTRA, 3500, 2000, 1500, 1250, 1200, 1190ULTRA-II, 1170, and 1255 (made in Columbia); Black Pearls: L, Legal: 400R, 330R, 660R, Mogul: L, Monarch: 700, 800, 880, 900, 1000, 1100, 1300, 1400, 2000, VULCAN: XC-72R (manufactured by Cabot Corp.); Color Black: FW1, FW2, FW2V, FW18, FW200, S150, S160, S170, Printex: 35, U, V, 140U, 140V, Special Black: 6, 5, 4A, and 4 (manufactured by Degussa): No. 25, No. 33, No. 40, No. 47, No. 52, No. 900, No. 2300, MCF-88, MA600, MA7, MA8, and MA100 (manufactured by Mitsubishi Chemical Corp.).

Of course, in the present invention, the carbon black is not limited to those mentioned above, and carbon black which has been known may also be used. In addition, magnetic fine particles, such as magnetite and ferrite, and pigments, such as titanium black, may also be used.

As the organic pigments, in particular, for example, the following may be used.

There may be used, for example, water-insoluble azo pigments such as toluidine red, toluidine maroon, Hansa yellow, benzidine yellow, and pyrazolone red; water-soluble azo pigments such as lithol red, helio bordeaux, pigment scarlet, and permanent red 2B; derivatives from vat dyes such as alizarin, indanthrone, and thioindigo maroon; phthalocyanine-based pigments such as phthalocyanine blue and phthalocyanine green; quinacridone-based pigments such as quinacridone red and quinacridone magenta; perylene-based pigments such as perylene red and perylene scarlet; isoindolinone-based pigments such as isoindolinone yellow and isoindolinone orange; imidazolone-based pigments such as benzimidazolone yellow, benzimidazolone orange, and benzimidazolone red; pyranthrone-based pigments such as pyranthrone Red and pyranthrone orange; indigo-based pigments, condensed azo-based pigments, thioindigo-based pigments, diketopyrrolopyrrole-based pigments, flavanthrone yellow, acylamide yellow, quinophthalone yellow, nickel azo yellow, copper azo methineyellow, perinone orange, anthrone orange, dianthraquinonyl red, and dioxazine violet.

In addition, when the organic pigments are each represented by the color index (C.I.) number, for example, the following may be used. Of course, besides the following pigments, organic pigments which have been known may also be used.

There may be used, for example, C.I. pigment yellow: 12, 13, 14, 17, 20, 24, 74, 83, 86, 93, 97, 109, 110, 117, 120, 125, 128, 137, 138, 147, 148, 150, 151, 153, 154, 166, 168, 180, 185, and the like; C.I. pigment orange: 16, 36, 43, 51, 55, 59, 61, 71, and the like; C.I. pigment red: 9, 48, 49, 52, 53, 57, 122, 123, 149, 168, 175, 176, 177, 180, 192, and the like; C.I. pigment red: 215, 216, 217, 220, 223, 224, 226, 227, 228, 238, 240, 254, 255, 272, and the like; C.I. pigment violet: 19, 23, 29, 30, 37, 40, 50, and the like; C.I. pigment blue: 15, 15:1, 15:3, 15:4, 15:6, 22, 60, 64, and the like; C.I. pigment green: 7, 36, and the like; and C.I. pigment brown: 23, 25, 26, and the like.

[Resin Dispersion Type Pigment]

In order to form an ink in which the pigment as described above is dispersed in an aqueous medium by a dispersant, that is, in order to form an ink containing a dispersant dispersible pigment, as the dispersant, for example, a water-soluble resin (water-soluble high molecular weight dispersant) is preferably used. As the dispersant, a dispersant which can stably disperse the above pigment in an aqueous medium by the function of anionic group and the like is preferable. The weight average molecular weight of the resin to be used as the dispersant is preferably 1,000 to 30,000 and more preferably 3,000 to 15,000. In addition, the acid value of the resin to be used as the dispersant is preferably 60 to 300 mgKOH/g, more preferably 80 to 200 mgKOH/g, and especially preferably 130 to 180 mgKOH/g. The content (percent by mass) of the resin to be used as the dispersant in the ink is preferably 0.1 to 5.0 percent by mass with respect to the total mass of the ink.

As particular examples of the resin to be used as the dispersant, for example, the following may be mentioned.

There may be mentioned, for example, a styrene-acrylic acid copolymer and a styrene-acrylic acid-alkyl acrylate copolymer; a styrene-maleic acid copolymer and a styrene-maleic acid-alkyl acrylate copolymer; a styrene-methacrylic acid copolymer and a styrene-methacrylic acid-alkyl acrylate copolymer; a styrene-maleic acid half ester copolymer; a vinylnaphthalene-acrylic acid copolymer and a vinylnaphthalene-maleic acid copolymer; a styrene-maleic anhydride-maleic acid half ester copolymer; or a salt of the copolymer mentioned above.

In addition, in order to improve the abrasion resistance, the water resistance, and the like of an image formed on regular paper or the like and to improve the glossiness and the like of an image formed on a glossy recording medium, an ink formed by adding the dispersant mentioned above as an anionic resin to an ink containing a color material, such as a dye, different from the pigments mentioned above may also be used.

[Self-Dispersible Pigment]

When ionic groups (anionic groups) are bonded to the surfaces of pigment particles, the pigment as mentioned above can be formed into a self-dispersible pigment which is dispersible in an aqueous medium without using a dispersant. In particular, for example, a self-dispersible carbon black in which anionic groups are bonded to the surfaces of carbon black particles may be mentioned. As the anionic group, for example, —$(COOM)_n$, —$SO_3M$, —$PO_3HM$, and —$PO_3HM_2$ may be mentioned. In addition, M in the formula represents a hydrogen atom, an alkali metal, ammonium, or an organic ammonium, and n represents an integer of 1 or more. Those anionic groups are each preferably bonded to the surface of the carbon black particle directly or indirectly with another atomic group (—R—) provided therebetween. As the another atomic group (—R—), for example, there may be mentioned an alkylene group, such as a methylene group, an ethylene group, or a propylene group, or an aromatic ring, such as a benzene ring or a naphthalene ring. In addition, the surface charge amount of the self-dispersible pigment is preferably 0.10 mmol/g or more and 2.00 mmol/g or less. The surface charge amount is represented by the amount of the anionic group on a surface of the pigment per 1 g of the pigment. The amount of the anion group introduced in the self-dispersible pigment may be obtained by a colloid titration.

(Resin Particles)

In the present invention, the "resin particles" represents particles formed of a resin which is dispersed in a solvent in the form of particles.

The 50%-cumulative volume average particle diameter ($D_{50}$) of the resin particles is preferably 10 to 1,000 nm and more preferably 40 to 500 nm. In addition, $D_{50}$ of the resin particles is measured by the following method. The resin particles are diluted by 50 times (volume basis) with purified water to form a dispersion liquid, and by using UPA-EX150 (manufactured by Nikkiso Co., Ltd.), measurement is performed under conditions in which Setzero, the number of measurements, the measurement time, and the refractive index are set to 30 s, 3 times, 180 seconds, and 1.5, respectively.

In addition, the polystyrene-based weight average molecular weight of a resin forming the resin particles obtained by gel permeation chromatography (GPC) is preferably 1,000 to 2,000,000.

The content (percent by mass) of the resin particles in the ink is preferably 3 to 30 percent by mass with respect to the total mass of the ink and more preferably 3 to 15 percent by mass.

As the resin particles, there may be used at least one type of resin particles which can be dispersed in the ink and which can obtain a desired addition effect. For example, resin particles selected from the resin particles which have been used as a component of an ink-jet ink may be used in accordance with the purpose.

As a monomer used for the resin particles, any monomers which can be polymerized by an emulsion polymerization method, a suspension polymerization method, a dispersion polymerization method, or the like may be used. By using different types of monomers, for example, acrylic-based, vinyl acetate-based, ester-based, ethylene-based, urethane-based, synthetic rubber-based, vinyl chloride-based, vinylidene chloride-based, and olefin-based resin particles may be obtained, and in particular, acrylic resin particles and urethane resin particles are preferably used.

The resin particles preferably have the same polarity as that of a water-soluble resin functioning as the pigment dispersant and that of a self-dispersible pigment, and when the water-soluble resin functioning as the pigment dispersant and the self-dispersible pigment are anionic, anionic resin particles are preferably used.

As concrete monomers usable for the acrylic resin particles, for example, there may be mentioned an α, β-unsaturated carboxylic acid or a salt thereof, such as (meth)acrylic acid, maleic acid, crotonic acid, angelic acid, itaconic acid, or fumaric acid; an α, β-unsaturated carboxylic acid ester compound, such as ethyl (meth)acrylate, methyl (meth) acrylate, butyl (meth)acrylate, methoxyethyl (meth)acrylate, ethoxyethyl (meth)acrylate, diethyleneglycol (meth)acrylate, triethyleneglycol (meth)acrylate, tetraethyleneglycol (meth)acrylate, polyethyleneglycol (meth)acrylate, methoxydiethyleneglycol (meth)acrylate, methoxytriethyleneglycol (meth)acrylate, methoxytetraethyleneglycol (meth)acrylate, methoxypolyethyleneglycol (meth)acrylate, cyclohexyl (meth)acrylate, isobornyl (meth)acrylate, N,N-dimethylaminopropyl (meth)acrylate, monobutyl maleate, or dimethyl itaconate; an α, β-unsaturated carboxylic acid alkylamide compound, such as (meth)acrylic amide, dimethyl (meth)acrylic amide, N,N-dimethylethyl (meth)acrylic amide, N,N-dimethylpropyl (meth)acrylic amide, isopropyl (meth)acrylic amide, diethyl (meth)acrylic amide, (meth) acryloyl morpholine, maleic acid monoamide, or crotonic acid methylamide; an α, β-ethylenic unsaturated compound having an aryl group, such as styrene, α-methylstyrene, phenyl vinyl acetate, benzyl (meth)acrylate, or 2-phenoxyethyl (meth)acrylate; or an ester compound of a polyfunctional alcohol, such as ethylene glycol diacrylate, or a propylene glycol dimethacrylate. Either a homopolymer formed by polymerization of a single monomer or a copolymer formed by polymerization of at least two types of monomers may be used. In the case of the resin particles formed of a copolymer, either a random copolymer or a block copolymer may be used. In particular, resin particles formed using a hydrophilic monomer and a hydrophobic monomer is preferable. As the hydrophilic monomer, an α, β-unsaturated carboxylic acid and a salt thereof may be mentioned, and as the hydrophobic monomer, α, β-unsaturated carboxylic acid ester compound or an α, β-ethylenic unsaturated compound having an aryl group may be mentioned.

The urethane resin particles are resin particles synthesized by a reaction between a polyisocyanate compound having at least two isocyanate groups and a polyol compound having at least two hydroxyl groups. In the present invention, any urethane resins each obtained by a reaction between a known polyisocyanate compound and a known polyol compound may be used as long as the conditions of the resin particles described above are satisfied.

In addition, as the structure of the resin particles, resin particles each having a monolayer structure and resin particles each having a multilayer structure, such as a core-shell structure, may be mentioned.

The acid value of the resin particles is preferably 3 to 100 mgKOH/g. Since the acid value of the resin particles is set in the range described above, when the clogging prevention liquid is supplied from the ejection port, the resin particles are likely to be present at the side of an ink having a high dielectric constant. The acid value of the resin particles can be measured by a potential-difference titration method. In addition, the resin particles each preferably have at least one of a carboxylic acid group, a phosphonic acid group, and a sulfonic acid group on the surface thereof. Since the resin particles each have at least one of a carboxylic acid group, a phosphonic acid group, and a sulfonic acid group on the surface thereof, when the clogging prevention liquid is supplied from the ejection port, the resin particles are likely to be present at the side of an ink having a high dielectric constant.

(Solvent)

As the aqueous medium of the ink, for example, water or a mixture of a water-soluble organic solvent and water may be used, and a mixture of water and a water-soluble organic solvent is preferably used. The content (percent by mass) of the water-soluble organic solvent in the ink is preferably 3.0 to 40.0 percent by mass with respect to the total mass of the ink. In addition, as the water, deionized water is preferably used. The content (percent by mass) of the water in the ink is preferably 50.0 to 95.0 percent by mass with respect to the total mass of the ink.

The content of the water-soluble organic solvent in the ink has an influence on the degree of clogging of the ink. When the ratio of the content of the water-soluble organic solvent to the content of the dispersion particles in the ink is small, clogging at the ejection port of the recording head is liable to occur by moisture evaporation from the ink. When the ratio of the content (percent by mass) of the water-soluble organic solvent to the content (percent by mass) of the dispersion particles in the ink is 1:2 or less, the clogging is liable to occur, and in particular, when the ratio is 1:1 or less, the clogging is more liable to occur. Even in the case of the ink composition as described above, when the clogging prevention liquid according to the present invention is used, the clogging at the ejection port of the recording head can be effectively prevented.

As the water-soluble organic solvent, for example, the following may be used. Those water-soluble organic solvents may be used alone, or at least two thereof may be used in combination.

There may be used, for example, an alkyl alcohol having 1 to 4 carbon atoms, such as methyl alcohol, ethyl alcohol, n-butyl alcohol, isopropyl alcohol, n-butyl alcohol, sec-butyl alcohol, or tert-butyl alcohol; an amide, such as dimethylformamide or dimethylacetamide; a ketone or a ketoalcohol, such as acetone or diacetone alcohol; an ether, such as tetrahydrofuran or dioxane; a polyalkylene glycol, such as a polyethylene glycol or a polypropylene glycol; an alkylene glycol in which the alkylene group has 2 to 6 carbon atoms, such as ethylene glycol, propylene glycol, butylene glycol, diethylene glycol, triethylene glycol, or hexylene glycol; a thioglycol; an alkylene ether acetate such as polyethylene glycol monomethyl ether acetate; a polyalcohol, such as glycerin or 1,2,6-hexane triol; an alkyl ether of a polyalcohol, such as ethylene glycol monomethyl (or monoethyl) ether, diethylene glycol methyl (or ethyl) ether, or triethylene glycol monomethyl (or monoethyl) ether; N-methyl-2-pyrrolidone, 2-pyrollidone, or 1,3-dimethyl-2-imidazolidinone.

Those water-soluble organic solvents are categorized into a good solvent and a poor solvent. Regardless of the dispersion method of the dispersion particles, a water-soluble solvent capable of maintaining a dispersion stability of the dispersion particles is a good solvent, and on the other hand, a water-soluble solvent disturbing a dispersion stability of the dispersion particles is a poor solvent. The good solvent and the poor solvent can be categorized by the following method.

"First, a dispersion liquid is prepared containing 50 percent by mass of a water-soluble organic solvent to be judged and 45 percent by mass of water and also containing 5 percent by mass of dispersion particles used for the ink in a dispersed state. After the dispersion liquid thus prepared is stored at 60° C. for 48 hours, when the average particle diameter of the dispersion particles in the liquid is increased as compared to the average particle diameter of an aqueous dispersion liquid separately prepared to contain 5 percent by mass of the dispersion particles and 95 percent by mass of water, this solvent is categorized into a poor solvent, and when the average particle diameter of the dispersion particles of the dispersion liquid is not changed or is decreased, this solvent is categorized into a good solvent."

For example, when a pigment using a styrene-ethyl acrylate-acrylic acid copolymer as the dispersant is used for the ink, as the good solvent, glycerin, ethylene glycol, and diethylene glycol may be mentioned. As the poor solvent, for example, 1,2-hexanediol and 1,5-pentanediol may be mentioned.

In the ink liable to cause clogging in which with respect to the content (percent by mass) of the dispersion particles (when the dispersion particles are formed of pigment and resin particles, the total content thereof) in the ink, the ratio of the content (percent by mass) of the water-soluble organic solvent is 1:2 or less, among the water-soluble organic solvents, an ink containing a large amount of a good solvent tends to easily cause clogging. This phenomenon is called a "withdrawing phenomenon" of dispersion particles, such as pigment and/or resin particles.

The "withdrawing phenomenon" is a phenomenon in which in association with moisture evaporation from the ejection port, the pigment and/or resin particles in the ink in the vicinity of the ejection port are moved to a rear portion direction of the ejection port, for example, to a liquid chamber side. When moisture of the ink is evaporated from the ejection port, in the ink in the vicinity of the ejection port, the concentration of the pigment and/or resin particles and that of the water-soluble organic solvent are increased.

From the state described above, the pigment and/or resin particles each having a charge of an ionized carboxyl acid or sulfonic acid are moved to the rear portion direction of each nozzle at which the moisture is present at a high concentration, for example, to the liquid chamber side (side opposite to the ejection port) by hydrophilic energy. In this case, when the ratio of a good solvent capable of maintaining the dispersion stability of the pigment and/or resin particles is high in the water-soluble organic solvent in the vicinity of the ejection port, the withdrawing phenomenon is not likely to occur. On the other hand, when the ratio of a poor solvent disturbing the dispersion stability of the pigment and/or resin particles is high in the water-soluble organic solvent in the vicinity of the ejection port, the withdrawing phenomenon is likely to occur.

When the moisture is evaporated from the ejection port, since the withdrawing phenomenon is not likely to occur in an ink having a high good solvent ratio, the aggregation of the pigment and/or resin particles may occur in the vicinity of the ejection port. When the ratio of the total poor solvent (percent by mass) with respect to the amount (percent by mass) of the water-soluble organic solvent in the ink is 10% or less, the withdrawing phenomenon is not likely to occur.

Even if an ink is used which has a low content of a poor solvent and in which the withdrawing phenomenon is not likely to occur, when the clogging prevention liquid according to the present invention is used, the clogging at the ejection port of the recording head can be effectively prevented.

(Other Components)

In order to maintain a moisture-retaining property, besides the components described above, moisture-retaining solid components, such as urea, an urea derivative, trimethylolethane, and trimethylolpropane, may be used for the ink. The content (percent by mass) of the moisture-retaining solid component in the ink is preferably 0.1 to 20.0 percent by mass with respect to the total mass of the ink. Those moisture-retaining solid components also have the effect of suppressing the clogging of ink as is the case of the water-soluble organic solvent. Furthermore, if needed, besides the components described above, various types of additives, such as a pH adjuster, a corrosion inhibitor, an antiseptic, a fungicide, an antioxidant, and a reduction inhibitor, may also be contained in the ink.

(Dispersion Particles)

As the dispersion particles, at least one type of pigment and resin particles described above is contained in the ink. By a clogging prevention treatment according to the present invention, a significant effect can be obtained even by an ink containing 10 percent by mass or more of the resin particles. In particular, when the ink contains both pigment and resin particles, and the total amount thereof is 10 percent by mass or more of the total amount of the ink, a significant effect can be obtained.

On the other hand, the content of the dispersion particles in the ink is preferably 25 percent by mass or less in view of the clogging prevention. When the content of the dispersion particles in the ink is more than 25 percent by mass, the advantage of the present invention may not be sufficiently obtained in some cases.

In addition, although at least one type of pigment and resin particles is used as the dispersion particles, when different particles are also added as the dispersion particles besides the pigment and resin particles, the different particles are also included in the dispersion particles.

(Viscosity and Surface Tension of Ink)

When the ink is imparted to a recording medium by an ink jet method (such as a thermal method or a piezoelectric method), the viscosity and the surface tension of the ink are preferably adjusted so as to obtain desired ink jet ejection characteristics.

The viscosity of the ink at 25° C. is set to preferably 20 mPa·s or less and more preferably 10 mPa·s or less.

The surface tension of the ink at 25° C. is set preferably in a range of 15 to 60 mN/m and more preferably in a range of 20 to 45 mN/m.

EXAMPLES

Hereinafter, the present invention will be described in detail with reference to examples and comparative examples. The present invention is not limited to the following examples and may be variously modified without departing from the scope of the present invention. In addition, in the following description, "part(s)" or "%" is the mass basis unless otherwise particularly noted.

(Preparation of Pigment Dispersion)

<Preparation of Black Pigment Dispersion Liquid>

After 10 parts of carbon black (trade name: Monarch 1100, manufactured by Cabot Corp.), 15 parts of a resin aqueous solution (obtained by neutralizing an aqueous solution containing 20.0 percent by mass of a styrene-ethyl acrylate-acrylic acid copolymer having an acid value of 130 and a weight average molecular weight of 8,000 with a potassium hydroxide aqueous solution), and 75 parts of purified water were mixed together and then charged into a batch type vertical sand mill (manufactured by Aimex Co., Ltd.), and 200 parts of zirconia beads having a diameter of 0.3 mm were further charged thereto, a dispersion treatment was performed for 5 hours while water cooling was performed. From this dispersion liquid, coarse and large particles were removed by a centrifugal operation, so that a black pigment dispersion liquid containing 10.0 percent by mass of the pigment was obtained.

<Preparation of Cyan Pigment Dispersion Liquid>

Except that C.I. Pigment Blue 15:3 was used instead of the carbon black, a cyan pigment dispersion liquid containing 10.0 percent by mass of the pigment was obtained in a manner similar to that of the "preparation of black pigment dispersion liquid".

(Preparation of Resin Particle Dispersion Liquid)

A mixture of 18 parts of ethyl methacrylate, 2 parts of 2,2'-azobis-(2-methyl butyronitrile), and 2 parts of n-hexadecane was prepared and then stirred for 0.5 hours. While this mixture was dripped to 78 parts of a 6%-aqueous solution of a styrene-butyl acrylate-acrylic acid copolymer (acid value: 130 mgKOH/g, and weight average molecular weight: 7,000), stirring was performed for 0.5 hours. Next, by using an ultrasonic irradiation machine, ultrasonic waves were irradiated for 3 hours. Subsequently, a polymerization reaction was performed at 80° C. for 4 hours in a nitrogen atmosphere, and after cooling was performed to room temperature, filtration was performed, so that a resin particle dispersion liquid containing 40.0 percent by mass of the resin was prepared. The weight average molecular weight of the resin particles was 250,000, the average diameter ($D_{50}$) was 200 nm, and the acid value was 22 mgKOH/g.

(Preparation of Ink)

After the components shown in the following Table 1 were mixed together at the respective blending rates (percent by mass) and were then sufficiently stirred, pressure filtration was performed using a microfilter (manufactured by FUJIFILM Corp.) having a pore size of 1.0 μm, so that inks 1 to 7 were prepared.

TABLE 1

| | | Ink | | | | | | |
|---|---|---|---|---|---|---|---|---|
| | | 1 | 2 | 3 | 4 | 5 | 6 | 7 |
| Pigment | Black pigment dispersion liquid (pigment component) | 40 (4) | | | 40 (4) | 40 (4) | 50 (5) | 40 (4) |
| | Cyan pigment dispersion liquid (pigment component) | | 40 (4) | | | | | |
| Resin particles | Resin particle dispersion liquid (resin component) | 30 (12) | 30 (12) | 37.5 (15) | 30 (12) | 12.5 (5) | | 30 (12) |
| Water-soluble organic solvent | glycerin | 10 | 10 | 10 | 12.5 | 10 | 10 | 14.5 |
| | Diethylene glycol | 5 | 5 | 5 | 7.5 | 5 | 5 | |
| | Polyethylene glycol (molecular weight: 600) | | | | | | | 15 |
| Surfactant | Acetylenol E100[1)] | 0.5 | 0.5 | 0.5 | 0.5 | 0.5 | 0.5 | 0.5 |
| | Water | 14.5 | 14.5 | 47 | 9.5 | 29.5 | 34.5 | 0 |
| Dielectric constant at 25° C.[2)] | | 73 | 73 | 73 | 72 | 74 | 74 | 62 |

[1)]Acetylene glycol ethylene oxide adduct: manufactured by Kawaken Fine Chemicals Co., Ltd.
[2)]Dielectric constant of liquid in ink other than pigment, dispersant and resin particles (Preparation of Liquid to be Supplied into Ejection Port)

After the components shown in the following Table 2 were mixed together at the respective blending rates (percent by mass) and were then sufficiently stirred, pressure filtration was performed using a microfilter (manufactured by FUJIFILM Corp.) having a pore size of 1.0 μm, so that liquids 1 to 7 (hereinafter, each referred to as "treatment liquid" in some cases) were prepared.

The dielectric constant was measured at 25° C. using a dielectric constant meter (trade name: "BI-870", manufactured by Brookhaven Instruments Corporation).

TABLE 2

| | Clogging prevention liquid | | | | | | |
|---|---|---|---|---|---|---|---|
| | 1 | 2 | 3 | 4 | 5 | 6 | 7 |
| 1,5-pentane diol | 100 | 80 | | | | | |
| Triethylene glycol | | | 100 | | | | |
| Diethylene glycol | | | | 100 | | | |
| Ethylene glycol | | | | | 100 | | |
| Glycerin | | | | | | 100 | |
| Polyethylene glycol (molecular weight: 400) | | | | | | | 100 |
| Water | | 20 | | | | | |
| Dielectric constant at 25° C. | 27 | 37 | 23 | 32 | 40 | 42 | 15 |

<Clogging Evaluation>

The inks obtained as described above were each filled in an ink cartridge, and this ink cartridge was mounted in an ink jet recording device (trade name: PIXUS Pro9500, manufactured by CANON KABUSHIKI KAISHA) ejecting an ink from a recording head by a thermal energy function. By the use of this ink jet recording device, after a cleaning operation of the recording head was performed once, a nozzle check pattern of dots formed on recording paper by the inks ejected from nozzles was recorded, so that the normal recording was confirmed. Next, the recording head of the above recording device was mounted in the recording device shown in FIG. 4. As a porous absorber used to impart the liquid, a hydrophilic polyurethane was used which sufficiently absorbed one of the liquids described above and which had an average pore diameter of 1 μm and a void rate of 70%. Next, by the liquid supply mechanism, the liquid was supplied into the ejection port of the recording head. Subsequently, without performing the capping on the recording head, the recording device shown in FIG. 4 was left for 5 days under the conditions in which the temperature was set to 30° C. and the relative humidity was set to 10% (hereinafter, referred to as "storage treatment" in some cases). Next, after this recording head was again mounted in PIXUS Pro9500, and cleaning was performed in accordance with the command from a printer driver, the nozzle check pattern was recorded. When the nozzle check pattern was not normally recorded, and the clogging was generated, cleaning was again performed in accordance with the command from the printer driver, and the nozzle check pattern was then repeatedly recorded. As described above, from the number of cleaning times required to record the normal nozzle check pattern, the clogging was evaluated in accordance with the following criteria.

Evaluation Criteria of Clogging

AA: After the storage treatment, when the cleaning was performed once, the normal nozzle check pattern was recorded.

A: After the storage treatment, when the cleaning was performed 2 to 3 times, the normal nozzle check pattern was recorded.

B: After the storage treatment, when the cleaning was performed 4 to 5 times, the normal nozzle check pattern was recorded.

C: After the storage treatment, when the cleaning was performed 6 to 10 times, the normal nozzle check pattern was recorded.

D: After the storage treatment, although the cleaning was performed 10 times, no normal nozzle check pattern was recorded.

As the examples of the present invention, the evaluation results using the liquids 1 to 5 having a dielectric constant of 20 to 40 at 25° C. are shown. In addition, as the comparative examples, the results obtained when the recording head was left for 5 days under conditions in which the temperature was set to 30° C. and the relative humidity was set to 10% without performing the liquid supply step, and the evaluation results using the liquids 6 and 7 having a dielectric constant out of a range of 20 to 40 at 25° C. are shown in Table 3.

TABLE 3

| | Treatment liquid supply step | Treatment liquid | Dielectric constant | Ink 1 | Ink 2 | Ink 3 | Ink 4 | Ink 5 | Ink 6 | Ink 7 |
|---|---|---|---|---|---|---|---|---|---|---|
| Example | yes | Treatment liquid 1 | 27 | B | A | A | A | A | AA | A |
| | yes | Treatment liquid 2 | 37 | B | A | A | A | A | AA | A |
| | yes | Treatment liquid 3 | 23 | C | C | B | B | A | A | B |
| | yes | Treatment liquid 4 | 32 | B | A | A | A | A | AA | A |
| | yes | Treatment liquid 5 | 40 | C | B | A | B | A | A | C |
| Comparative example | no | — | — | D | D | C | C | C | B | D |
| | yes | Treatment liquid 6 | 42 | D | D | C | C | C | B | D |
| | yes | Treatment liquid 7 | 15 | D | D | C | D | D | C | D |

As apparent from the above results, according to the present invention, clogging by aggregation of pigment and/or resin particles generated with the progress of moisture evaporation from the ejection-port surface can be prevented, and the ejection stability can be maintained for a long period of time.

Although the present invention has been described with reference to the embodiments, the present invention is not limited to the above embodiments. Without departing from the technical scope of the present invention, various changes which can be understood by a person skilled in the art may be performed on the structure and the details of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-138671 filed Jul. 10, 2015, which is hereby incorporated by reference herein in its entirety.

What is claimed is:

1. An ink jet recording device comprising:

a recording head having:

an ejection port configured to eject an aqueous ink; and an ejection-port surface in which the ejection port is opened; and a liquid supply mechanism configured to supply an ejection-port clogging prevention liquid into the ejection port, wherein the aqueous ink contains at least one component selected from the group consisting of pigment particles and resin particles, and wherein the clogging prevention liquid has a dielectric constant of 20 to 40 at 25° C.

2. The ink jet recording device according to claim 1, wherein the liquid supply mechanism comprises:

a liquid holding portion configured to hold the clogging prevention liquid; and a press unit configured to press the liquid holding portion to the ejection-port surface.

3. The ink jet recording device according to claim 2, wherein the liquid holding portion is formed of a porous absorber configured to hold the clogging prevention liquid.

4. The ink jet recording device according to claim 1, further comprising a discharge mechanism configured to discharge the clogging prevention liquid supplied into the ejection port to a location outside the ink recording device.

5. The ink jet recording device according to claim 1, wherein the aqueous ink contains both the pigment particles and the resin particles, and wherein a total amount of the pigment particles and the resin particles in the ink is 10 percent by mass or more of the total ink mass.

6. The ink jet recording device according to claim 1, wherein the aqueous ink contains a liquid, and wherein the dielectric constant of the liquid in the aqueous ink is 50 to 80 at 25° C.

7. The ink jet recording device according to claim 1, wherein the difference in dielectric constant at 25° C. between the clogging prevention liquid and the liquid in the aqueous ink is 25 or more.

8. The ink jet recording device according to claim 2, wherein the liquid supply mechanism is configured to supply the ejection-port clogging prevention liquid into the ejection port such that the ejection-port clogging prevention liquid travels from the liquid holding portion into the ejection portion via the ejection-port surface.

9. The ink jet recording device according to claim 1, wherein the recording head further comprises a liquid chamber configured to contain the aqueous ink, and wherein the liquid supply mechanism is configured to supply the ejection-port clogging prevention liquid into the liquid chamber via the ejection port.

10. The ink jet recording device according to claim 3, wherein the press unit is configured to press the liquid holding portion to the ejection-port surface such that the porous absorber is in contact with the ejection-port surface.

11. The ink jet recording device according to claim 3, wherein a pore diameter of the porous absorber is 100 nm to 100 μm.

12. The ink jet recording device according to claim 3, wherein a void rate of the porous absorber is 60% to 90%.

13. The ink jet recording device according to claim 3, wherein the porous absorber is pressed to the entire ejection-port surface.

14. The ink jet recording device according to claim 1, wherein the ejection-port clogging prevention liquid comprises 80% by mass or more of one or more water-soluble organic solvents.

15. The ink jet recording device according to claim 1, wherein the ejection-port clogging prevention liquid comprises 80% by mass or more of one or more components selected from the group consisting of a diol having 2 to 7 carbon atoms, a triol having 2 to 7 carbon atoms, and a pyrrolidone.

16. The ink jet recording device according to claim 1, wherein the ejection-port clogging prevention liquid comprises 80% by mass or more of one or more components selected from the group consisting of triethylene glycol, 3-methyl-1,5-pentanediol, 1,5-pentanediol, 1,2,6-hexanetriol, 1,2-propanediol, diethylene glycol, and 2-pyrrolidone.

17. An ink jet recording device comprising:

a recording head having:

an ejection port configured to eject an aqueous ink; and an ejection-port surface in which the ejection port is opened; and a liquid supply mechanism having:

a liquid holding portion configured to hold the clogging prevention liquid; and a press unit configured to press the liquid holding portion to the ejection-port surface, wherein the aqueous ink contains at least one component selected from the group consisting of pigment particles and resin particles, and wherein the clogging prevention liquid has a dielectric constant of 20 to 40 at 25° C.

* * * * *